US009863223B2

(12) United States Patent
Farrow

(10) Patent No.: US 9,863,223 B2
(45) Date of Patent: Jan. 9, 2018

(54) PLUNGER ASSEMBLY WITH DUAL DART SYSTEM

(71) Applicant: James T. Farrow, Grand Prairie, TX (US)

(72) Inventor: James T. Farrow, Grand Prairie, TX (US)

( * ) Notice: Subject to any disclaimer, the term of this patent is extended or adjusted under 35 U.S.C. 154(b) by 175 days.

(21) Appl. No.: 14/980,112

(22) Filed: Dec. 28, 2015

(65) Prior Publication Data

US 2017/0183947 A1 Jun. 29, 2017

(51) Int. Cl.
*E21B 43/12* (2006.01)

(52) U.S. Cl.
CPC ..... *E21B 43/126* (2013.01)

(58) Field of Classification Search
CPC ..... E21B 43/121; E21B 43/126
See application file for complete search history.

(56) References Cited

U.S. PATENT DOCUMENTS

| | | | | |
|---|---|---|---|---|
| 9,109,424 | B2 | 8/2015 | Jefferies | |
| 2003/0155117 | A1 | 8/2003 | Gray | |
| 2006/0065390 | A1* | 3/2006 | Amies | E21B 43/121 166/105 |
| 2009/0038796 | A1 | 2/2009 | King | |
| 2014/0246209 | A1 | 9/2014 | Themig et al. | |
| 2014/0262204 | A1 | 9/2014 | Farris | |
| 2016/0108710 | A1 | 4/2016 | Hightower | |
| 2016/0168963 | A1 | 6/2016 | Roycroft et al. | |

OTHER PUBLICATIONS

Office Action in related U.S. Appl. No. 14/072,651, dated May 5, 2017, 15 pages.
Office Action in related U.S. Appl. No. 14/705,941, dated May 16, 2017, 13 pages.
Office Action in related U.S. Appl. No. 14/745,096, dated May 16, 2017, 14 pages.
Office Action in related U.S. Appl. No. 14/745,142, dated May 16, 2017, 16 pages.

* cited by examiner

*Primary Examiner* — Giovanna C. Wright
*Assistant Examiner* — Yanick A Akaragwe
(74) *Attorney, Agent, or Firm* — Law Office of Jeff Williams; J. Oliver Williams

(57) ABSTRACT

The present application includes and assembly having a dual dart assembly operable between an upper cage and a lower cage. The dual dart assembly is configured to connect an upper dart and a lower dart via a connecting rod. Therefore movement of one dart causes equal movement in the other dart. Movement of the dart is dampened upon impact at the top and bottom of the well by restriction of the working fluid as the dart assembly seats and unseats. A series of expandable seals are independently operated around the outer body and configured to expand and contact the outer wall in response to pressure increases within the outer body.

18 Claims, 3 Drawing Sheets

PLUNGER ASSEMBLY WITH DUAL DART SYSTEM

BACKGROUND

1. Field of the Invention

The present application relates generally to oil field devices and, more particularly, to a plunger assembly with a connected dual dart assembly.

2. Description of Related Art

The oil and gas industry has been drilling holes and removing natural crude oil for decades. Wells contain any number of contaminants, particulates, and water along with the gas/oil being sought. If water is not removed, pressure of the hydrostatic head of water in the surface tubing will become greater than that of the bottom hole pressure, thereby essentially sealing the formation and shutting in the well. Gas cannot on its own pressure typically flow to the surface.

Plungers are downhole tools used by operators to remove contaminants and water from productive natural gas wells. A plunger acts as an artificial lift. In operation the plunger passes down through the well until it reaches a contact point, at which point, potential energy of the plunger falling in the well acts to partially restrict the flow of working fluid through the plunger. Pressure beneath the plunger builds and raises the plunger in the well, thereby pushing out the liquids and contaminants above the plunger.

Typical plunger lift systems rely on the potential energy of the system falling in the well to generate enough force such that upon impact, a dart in the lower portion of the plunger moves to restrict flow of the working fluid through the body of the plunger. In other words, the contact itself sets the dart and generates a seal. Such designs generate a lot of forces on the tool and the equipment (i.e. the stop) at the bottom of the well upon impact. Tools are commonly damaged from the impacts.

An additional disadvantage is the effect of a "drift diameter" restraining the size of the plunger in relation to the well bore. The drift diameter is the minimum inside diameter of the tube in order to pass a ridged tool of some set length through it. Tools are designed to have a maximum diameter no greater than the drift diameter of the tubing. This results in the tools having a gap between them and the ID of the tubing. The large annulus or gap between the tool and the tubing that the tools passes through are one reason why tools tend to be inefficient because plunger lift tools work on a pressure gradient between fluid beneath the tool and fluid above the tool. Leaks between the tool and tubing impact the pressure gradient.

Another disadvantage of conventional plunger lift systems are the particulates (i.e. sand) in the working fluid. The working fluid passes within the gap between the plunger lift system and the casing at increased speeds resulting in tools abrading quickly. Additionally, the leak leads to turbulence created around the down hole edge of the tool when it expands after passing through the leak.

Furthermore a disadvantage remains in that typical plunger lifts require the use of a striker rod in a lubricator located at the top of the well. This extra member of the plunger lift system is used as an impact point for the plunger and to unseat the dart which had been sealed and seated at the bottom of the well. By unseating the dart, the working fluid is once again able to pass through the plunger and the plunger may fall. Plungers can often have limitations on the type of lubricator and striker rod they are compatible with. As flow rates vary within the well, different plungers may be used, thereby requiring the extra time and money necessary to change out the lubricator or striker rod.

Although great strides have been made, considerable shortcomings remain. A new plunger lift assembly tool is required that is usable without a lubricator and striker rod, dampens impact forces, minimizes abrading, and corrects for the constraints associated with the drift diameter.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
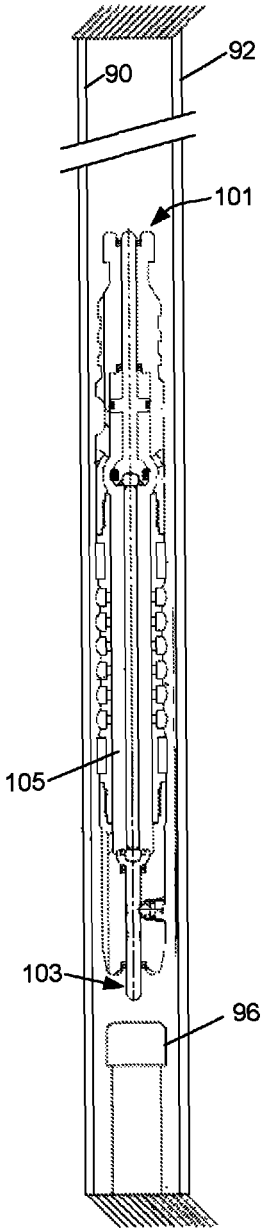
FIG. 1 is a side section view of a plunger assembly with a dual dart assembly according to the preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly in accordance with the present application overcomes one or more of the above-discussed problems commonly associated with conventional plunger lift systems as described above. The assembly of the present application is configured to translate within the tubing of a well bore between a raised top position and a lowered bottom position. The raised top position is located at the surface of the well bore while the lowered bottom position is located at the base of the well bore deep within the ground. Specifically, the assembly is configured to include a dual dart assembly wherein a dart is located at either end of the plunger assembly and is connected together via a connecting rod. The movement of one dart moves the other dart. Additionally, the assembly is configured to provide an internal dampening effect on both darts through a single bleed port. The bleed port dampens the impact of the plunger assembly at both the top and bottom of the well. Furthermore, the plunger assembly is configured to decrease wear on the body of the assembly by using individually operated expandable seals spaced along the body. Wear pads are also used to protect the outer body and provide many benefits described herein. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The plunger assembly of the present application is illustrated in the associated drawings. The assembly includes a three part body including a center body, an upper cage, and a lower cage. Each cage includes a dart wherein both darts are coupled together. Movement of one dart therefore moves the other dart in a corresponding manner. Referring now to the drawings wherein like reference characters identify corresponding or similar elements in form and function throughout the several views. FIG. 1 illustrates plunger assembly 101 within tubing 90 of a well bore 92. Assembly 101 is configured to operate without the use of a striker rod inside tubing 90. The operation of assembly 101 is similar on both ends of the plunger body. At the bottom of the well bore is a bumper 96 (i.e. some type of equipment) used to move the dart from a first position to a second position. Likewise, at the top of well bore 92 is a similar piece of equipment where the dart is moved from a second position to a first position. The forces generated by assembly 101 during the fall and rise through tubing 90 are transferred to assembly 101. After contact with bumper 96 at the lower end of well bore 92 a pressure gradient begins to form from the formation pressure and causes assembly 101 to rise within tubing 90 toward the surface. Movement of the dart assembly has restricted flow of the working fluid through the assembly body. After contact at the top of well bore 92, the dart is moved which opens or unrestricts the flow of working fluid through the assembly body and therefore permits the plunger assembly 101 to fall within well bore 92. The plunger assembly 101 of the present application is configured to translate and operate within tubing 90 between the top end and the lower end of the well bore. As the plunger assembly 101 rises within tubing 90, contaminants, particulates, and water above the assembly are brought to the surface.

As seen in FIG. 1, assembly 101 includes a body having a central channel 105 and a dual dart assembly 103. Dart assembly 103 is configured to translate within central channel 105 between the first and second positions in order to selectively restrict and unrestrict the flow of working fluid within well bore 92. Assembly 101 is shown in FIG. 1 in a falling configuration just prior to impact with bumper 96.

Figure 2:
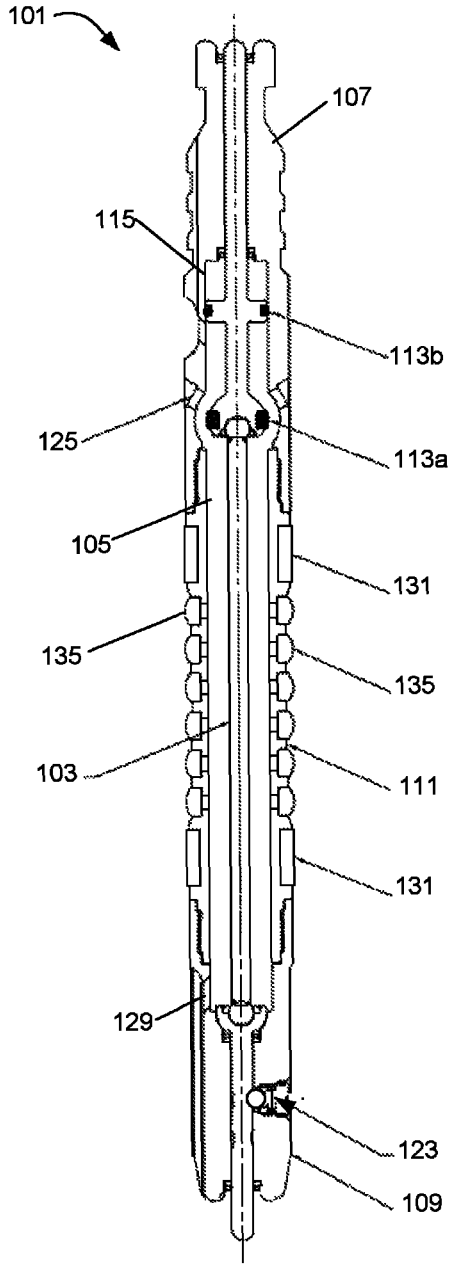
FIG. 2 is an enlarged side section view of the plunger assembly of FIG. 1.

Referring now also to FIGS. 2-8 in the drawings, plunger assembly 101 is shown in greater detail. An enlarged view of plunger assembly 101 is illustrated in FIG. 2. Plunger assembly 101 includes an outer body consisting of three members: an upper cage 107, a lower cage 109, and a center body 111. Upper cage 107 and lower cage 109 are coupled to opposing ends of body 111. Central channel 105 passes through a portion of upper cage 107, lower cage 109, and through body 111 to allow for the passage of working fluid to pass through the outer body.

Figure 3:
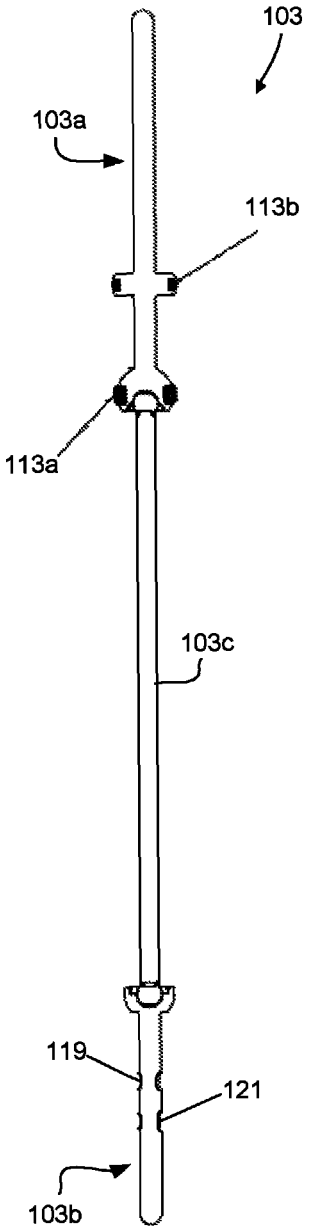
FIG. 3 is a side view of the dual dart assembly of FIG. 1.

As seen in greater detail in FIG. 3, dual dart assembly 103 is illustrated. Dart assembly 103 is in communication with upper cage 107 and lower cage 109. Dual dart assembly 103 operates between the first position and the second position by translating through central channel 105. Dual dart assembly 103 has an upper dart **103*a* located in upper cage 107 and a lower dart 103*b* located in lower cage 109. Upper dart 103*a* and lower dart 103*b* are coupled together via a connecting rod 103*c*, such that movement of one dart moves the opposing dart. Rod 103*c* may be coupled to darts 103*a*/103*b* in various manners. A rigid connection is possibly, however a connection that permits at least one degree of freedom is preferred in order to prevent potential issued from misalignment. As seen in FIG. 3, darts 103*a*/103*b* are coupled to rod 103*c* via a ball and socket type of connection. This hinged connection allows some independent rotation of each dart relative to rod 103*c***. Independent axial movement is restricted however.

Dual dart assembly 103 further includes one or more seals 113. A pressure seal **113*a* is located at the base of upper dart 103*a* and is configured to contact a seat 115 as dart assembly 103 is moved into and out of the second position. Seal 113*a* creates a seal between dart 103*a* and upper cage 107 around the circumference of dart 103*a*. Seals 113*b* are also seen to create a seal with seat 115. The use of seals 113*a* and 113*b* help to provide a dampening effect upon dart assembly 103 at impact with the upper and lower portions of well bore 92**.

Figure 5:
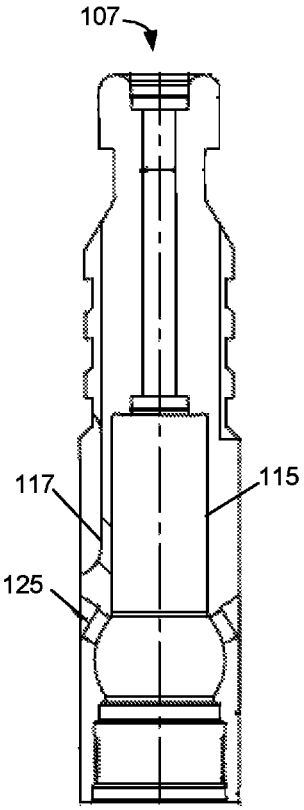
FIG. 5 is a side section view of an upper cage in the plunger assembly of FIG. 1.

As seen in particular in FIG. 5, upper cage 107 includes a bleed port 117. Port 117 is located within seat 115 ideally between the range of motion of dart **103*a* between the first and second positions. For example, dual dart assembly 103 is located in its first position in FIG. 2. Seal 113*a* is outside of seat 115 in central channel 105, however seal 113*b* is positioned just above port 117. Port 117 is configured to remain between seals 113***a* and 113*b* as dual dart assembly 103 translates between the first and second positions. Bleed port 117 is configured to dampen the movement of the dual dart assembly 103 as the dual dart assembly 103 moves between the first position and a second position. As assembly 101 is falling and impacts bumper 96, assembly 103 is translated to the second position (pushed upward) wherein seals 113*a* contact seat 115 and the fluid between seals 113*a* and 113*b* are pushed out through port 117. Likewise as assembly 101 is rising and impacts the upper portion of well bore 92, dart assembly 103 is translated to the first position (pushed downward) wherein working fluid is pulled within seat 115 through port 117. This dampening effect can be regulated by modifying the size of port 117.

Referring now back to FIG. 3, dual dart assembly 103 is shown to include a number of recesses. Assembly 103 includes an upper recess 119 and a lower recess 121. Recesses 119 and 121 are configured to hold dart assembly 103 in a particular position as assembly 101 is translating within well bore 92. As seen in FIG. 2, assembly 101 includes a ball detent plunger assembly 123 configured to position the dual dart assembly between the first position and the second position. Contact of the ball detent plunger 123 within upper recess 119 locates assembly 103 in the first position as seen in FIG. 2. Contact of ball detent plunger 123 within lower recess 121 locates assembly 103 in the second position. Ball detent plunger assembly 123 is configured to have a ball portion that is spring loaded so as to selectively retract within lower cage 109 as impact forces move assembly 103. Ball detent plunger assembly is adjustable such that the required force to transition the dual dart assembly 103 between the first position and the second position is selectable. A nut and clutch are used to help provide the adjustment possibilities by selectively locating the ball closer to or further from dart 103*b*.

Assembly 101 further includes an internal pressure relief port 125 in upper cage 107. Internal pressure relief port 125 is configured to remain unobstructed by the dual dart assembly 103 in either the first position, the second position, or travel there between each position. Internal pressure relief port 125 is configured to moderate the pressure differential between the working fluid adjacent upper cage 107 and the working fluid adjacent lower cage 109. By moderating or regulating the pressure differential, working fluid is permitted to pass through central channel 105 and exit upper cage 107 while assembly 101 is rising in well bore 92. By permitting the flow of working fluid through central channel 105 while assembly 101 is rising, the speed of assembly 101 is more controlled and less susceptible to blow out or experience harsh impacts at the upper end of tubing 90. It is understood that this may limit some applications of assembly 101 to wells having a higher rate of production (more pressure) but will help assembly 101 handle such wells which may not be typically used with conventional plungers. It is understood that an operator may selectively plug or restrict the flow through port 125 to accommodate various wells and their production rates.

Figure 8:
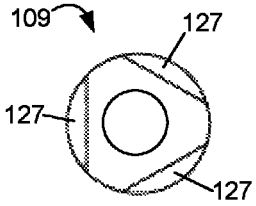
FIG. 8 is a bottom view of the lower cage of FIG. 6.
Figure 6:
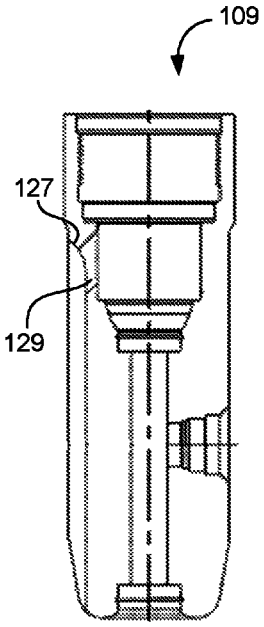
FIG. 6 is a side section view of a lower cage in the plunger assembly of FIG. 1.

Referring now to FIGS. 6 and 8 in the drawings. Lower cage 109 is configured to include an external taper 127. As seen with the use of port 125 above, it can be desirable to regulate the speed at which assembly 101 moves through well bore 92. Taper 127 is configured to regulate the fall rate of assembly 101. By increasing and decreasing the size of taper 127, the fall rate of assembly 101 may be modified. As seen in FIG. 8, an end view of lower cage 109 is illustrated, tapers 127 are seen. The depth of taper 127 and the number of tapers used around the annulus affects the cross sectional area of assembly 101. Assembly 101 is configured to permit various sized tapers 127 as necessary for desired applications and wells.

Furthermore with FIG. 6, lower cage 109 includes a fluid port 129 configured to permit the passage of the working fluid into center channel 105. Fluid port 129 is sloped relative to the axis of center channel 105 so as to minimize turbulence of the working fluid upon entering center channel 105. In other words, the location of the opening of port 129 along the outer surface of lower cage 109 is lower than the opening of port 129 on the inner surface of lower cage 109. As fluid arrives at port 129, the fluid is able to more easily pass through into channel 105. Turbulence commonly seen with ports orthogonally oriented relative to the flow of working fluid is avoided. It is understood that any number of ports 129 may be used. More than one port 129 is possible on each flat of taper 127.

Figure 7:
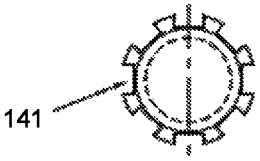
FIG. 7 is a top view of an outer body of the plunger assembly of FIG. 1.

FIG. 7 illustrates a top view of an exterior portion of the outer body. Working fluid needs to pass by or through the outer body as assembly 101 falls in the well bore. Various factors limit this from happening. A drift diameter for assembly 101 and the well bore often lead to close tolerances between assembly 101 and tubing 90. Particulates may also clog or obstruct selected passage ways within tubing 90. The plunger tool itself may become clogged in any one of the ports. Limitations to the free flow of working fluid around or through assembly 101 can result in failed operation. In order to increase the flow of working fluid around assembly 101 while maintaining the close drift diameter tolerances, portions of the outer body include a series of external channels 141. Channels 141 are designed to provide routes for the passage of working fluid as assembly 101 falls within the well bore. Channels 141 are axially aligned with length of the outer body. It is understood that some embodiments may elect to provide non axial alignment if rotation of assembly 101 is desired.

Working fluid within the tubing of the well bore contains a number of contaminants, debris, particulates, oils, and so forth that can be abrasive and damaging to objects and tools. These provide a constant abrasive and corrosive effect upon the body of assembly 101. Assembly 101 is configured to include one or more wear pads 131. Pads 131 are located in any portion of the outer body. As seen in FIG. 2, pads 131 are located within grooves 133 (FIG. 4) and are configured to extend beyond the outer diameter of the outer body. Pads 131 are designed to be located at locations where abrasion are highest. Pads 131 are releasably coupled to the outer body and may be replaced when worn. In this way, pads 131 act as a sacrificial member of assembly 101 by protecting the outer body from exposure to contaminants and particulates in the working fluid. The design, shape, and contour of pads 131 are variable and may be selected based upon design constraints and application.

Figure 4:
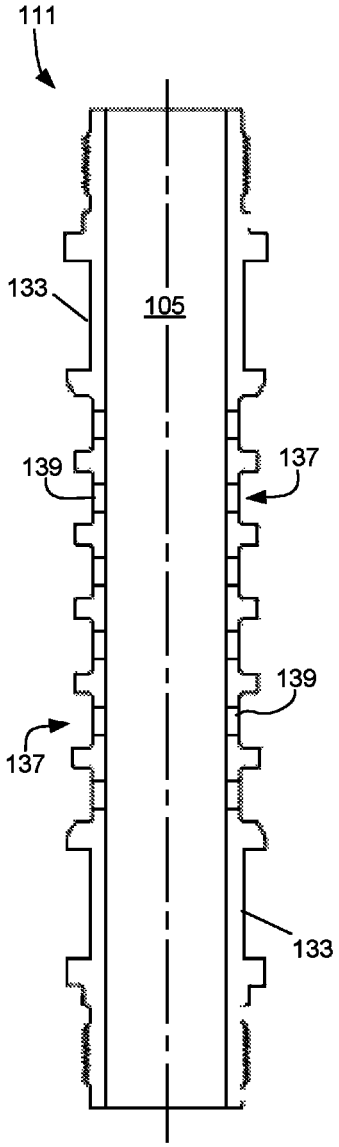
FIG. 4 is a side section view of the a center body of the plunger assembly of FIG. 1.

Referring now to FIGS. 2 and 4 in the drawings, assembly 101 is configured to include one or more expandable seals 135 releasably coupled to the outer body. The Figures illustrate seals 135 being in communication with center body 111 but it is understood that either cage 107 and 109 may be modified to include seals 135 in other embodiments. Seals 135 are configured to selectively increase in diameter as pressure builds within channel 105 such that seals 135 expand the effective outer diameter of assembly 101 and contact tubing 90.

Seals 135 are configured to stretch but there is a balance between the hardness and flexibility of seal 135. Seal 135 is hard enough to provide sufficient abrasion to the walls of well bore 92 but yet is flexible enough to expand at a pressure level lower than is necessary to lift assembly 101. Seal 135 is configured to have sufficient flexibility to accommodate variations in well bore diameter, meaning that the diameter of seal 135 may increase or decrease as assembly 101 rises within the well bore. Seals 135 may be formed from a hardened and flexible plastic or polyurethane material. Seals 135 are individually located within separate groove 137 located on center body 111.

As seen in FIG. 4, center body 111 includes an expandable seal port 139 configured to allow pressure within channel 105 to pass through to seals 135. Each seal is independently operable from the other expandable seals 135 because each seal is in direct fluid communication with channel 105. In other words, each groove 137 includes a separate seal port 139. It is understood that some ports 139 may be used to operate one or more seals 135 in other embodiments and are herein contemplated. As pressure builds within channel 105, the working fluid passes through ports 139 and press outward against seals 135 thereby causing seals 135 to expand in diameter.

There are many advantages of having seal 135 contact the walls of the tubing in the well bore, some of them are as follows: (1) Seal 135 rubs and scrapes the walls clean when rising. This serves to prolong the life of the tubing/casing and maintain the integrity of the well bore. (2) Scale buildup decreases the relative internal diameter of the tubing leading to potential clogging of tools. Seal 135 therefore maintains the drift diameter. (3) Seal 135 creates a seal against the walls that prevents the passage of working fluid (leakage). Therefore, creating the seal reduces abrading. (4) Contact between expandable seal 135 and the walls increases stabilization of assembly 101.

The current application has many advantages over the prior art including at least the following: (1) dual dart assembly; (2) ability to operate within a well bore without the use of a lubricator or striker rod; (3) use of optional wear pads; (4) a bleed port to dampen impact forces at the top and bottom of the well bore; (5) an internal pressure relief port to control the speed of ascent within the well bore; (6) independently operated expandable seals to prevent leakage of working fluid between the assembly and the walls of the well bore; and (7) a tapered lower cage.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A plunger assembly for removing contaminants in working fluid within a well, comprising:

an outer body including:

a center body having one or more pressure ports configured to allow the passage of the working fluid within the well under pressure;

an upper cage coupled to the center body; and a lower cage coupled to an opposing end of the center body as that of the upper cage, a central channel passes through a portion of the lower cage, the upper cage and through the center body to allow for the passage of the working fluid;

a dual dart assembly in communication with the upper cage and the lower cage, the dual dart assembly being located within the central channel, the dual dart having an upper dart in the upper cage and a lower dart in the lower cage, the lower dart and the upper dart being coupled together via a connecting rod, such that movement of one dart moves the opposing dart; and one or more expandable seals releasably coupled to the outer body, the one or more expandable seals being configured to selectively increase in diameter and contact walls of the well, the one or more expandable seals are each independently operable from the other expandable seals.

2. The assembly of claim 1, wherein the lower dart and the upper dart are hingedly coupled to the connecting rod.

3. The assembly of claim 1, further comprising:

a ball detent plunger in the lower cage configured to position the dual dart assembly between a first position and a second position, the dual dart assembly includes a lower recess and an upper recess along the lower dart, the contact of the ball detent plunger within the lower recess and the upper recess locates the dual dart assembly in the first position and the second position.

4. The assembly of claim 3, wherein the ball detent plunger is adjustable such that the required force to transition the dual dart assembly between the first position and the second position is selectable.

5. The assembly of claim 1, wherein the upper cage includes a bleed port configured to dampen the movement of the dual dart assembly as the dual dart assembly moves between a first position and a second position.

6. The assembly of claim 1, further comprising:

an internal pressure relief port configured to remain unobstructed by the dual dart assembly, the internal pressure relief port configured to moderate the pressure differential between the working fluid adjacent the upper cage and the working fluid adjacent the lower cage.

7. The assembly of claim 6, wherein the internal pressure relief port is configured to be selectively plugged.

8. The assembly of claim 1, wherein the lower cage includes an external taper configured to regulate the fall rate.

9. The assembly of claim 1, wherein the lower cage includes a fluid port configured to permit the passage of the working fluid into the center channel, the fluid port sloped relative to the axis of the center channel so as to minimize turbulence of the working fluid upon entering the center channel.

10. The assembly of claim 1, further comprising:

a wear pad releasably coupled to an outer surface of the center body.

11. The assembly of claim 10, wherein the wear pad is configured to protect the center body from exposure to contaminants and particulates in the working fluid.

12. The assembly of claim 1, wherein each of the one or more expandable seals are individually in direct fluid communication with the central channel.

13. The assembly of claim 1, wherein the diameter of the one or more expandable seals expand and contacts the walls of the well when the dual dart assembly is seated in the lower recess.

14. The assembly of claim 1, wherein the contact between the expandable seal and the walls occur as the assembly rises within the well.

15. The assembly of claim 1, wherein the contact during rising removes deposits and scales from the walls.

16. The assembly of claim 1, wherein contact between the expandable seal and the walls of the well are configured to increase stabilization of the assembly within the well.

17. The assembly of claim 1, wherein the expansion of the expandable seal minimizes leakage of working fluid between the assembly and the well.

18. The assembly of claim 1, wherein at least one of the upper cage, the lower cage and the center body include a plurality of axially aligned channels along an outer surface configured to allow working fluid to pass when descending.

* * * * *